US005572963A

United States Patent [19]

Kawasaki et al.

[11] Patent Number: 5,572,963

[45] Date of Patent: Nov. 12, 1996

[54] HYDRAULIC TAPPET

[75] Inventors: Keiji Kawasaki, Chiryu; Shinichi Miwa, Tajimi, both of Japan

[73] Assignee: NGK Insulators, Ltd., Nagoya, Japan

[21] Appl. No.: 213,529

[22] Filed: Mar. 16, 1994

[30] Foreign Application Priority Data

Mar. 30, 1993 [JP] Japan ..... 5-072577

[51] Int. Cl.[6] ..... B60K 17/00; F01L 1/16; F01L 1/24

[52] U.S. Cl. ..... 123/90.51; 123/90.55; 74/569

[58] Field of Search ..... 123/90.48, 90.51, 123/90.55, 90.33, 90.35; 74/569

[56] References Cited

U.S. PATENT DOCUMENTS

| | | | |
|---|---|---|---|
| 4,367,701 | 1/1983 | Buente | 123/90.51 |
| 4,590,898 | 5/1986 | Buente et al. | 123/90.51 |
| 4,648,360 | 3/1987 | Schaeffler | 123/90.55 |
| 4,715,334 | 12/1987 | Buente et al. | 123/90.55 |
| 4,768,476 | 9/1988 | Behnke et al. | 123/90.51 |
| 4,802,448 | 2/1989 | Ableitner | 123/90.55 |
| 5,081,976 | 1/1992 | Dahm et al. | 123/90.51 |
| 5,129,372 | 7/1992 | Seiberth et al. | 123/90.51 |
| 5,320,074 | 6/1994 | Schultz et al. | 123/90.51 |

FOREIGN PATENT DOCUMENTS

| | | | |
|---|---|---|---|
| 3529446 | 2/1987 | Germany | 123/90.55 |
| 60-219407A | 11/1985 | Japan . | |
| 62-276206A | 12/1987 | Japan . | |
| 1-170704A | 7/1989 | Japan . | |

OTHER PUBLICATIONS

Automobile Technical Handbook pp. 71–72, Mar. 1, 1991.

*Primary Examiner*—Weilun Lo
*Attorney, Agent, or Firm*—Ronald J. Kubovcik

[57] ABSTRACT

A hydraulic tappet includes a cam sliding portion, a skirt portion and a spring holding portion. The structure has an arrangement that the cam sliding portion is made of ceramic and oil is reserved in the spring holding portion. There is provide a hydraulic tappet capable of efficiently using motive power from a crank shaft, reducing transmission loss and improving the efficiency of the engine.

3 Claims, 3 Drawing Sheets

HYDRAULIC TAPPET

BACKGROUND OF THE INVENTION AND RELATED ART STATEMENT

The present invention relates to a tappet for a valve mechanism for an internal combustion engine, for example, an engine for an automobile, and more particularly to a hydraulic tappet made of ceramic and capable of improving the efficiency of the engine for an automobile.

Hitherto, an internal combustion engine, such as an engine for an automobile, has been arranged in such a way that a tappet or a rocker arm is disposed at an end of a valve shaft to transmit, to a valve mechanism, the kinetic force of the cam. Further, thermal expansion or thermal shrinkage of a cylinder head or a valve occurring at the time of the operation and incomplete seating of the valve occurring due to wear of the valve or a valve seat are prevented and the kinetic characteristics of the valve system are improved by disposing a hydraulic or mechanical adjustment mechanism in a portion in which the tappet or the rocker arm is in contact with the end of the valve shaft.

FIG. 5 illustrates an example of a conventional tappet of a hydraulic adjustment type. If a cylinder head (omitted from illustration) or a valve 18 encounters thermal expansion or thermal shrinkage, the hydraulic pressure of an oil reservoir disposed in a metal tappet 10 is used to adjust the position of the spring portion for pressing the valve of the tappet so that the transmission characteristics from a cam 17 are compensated.

However, a conventional tappet of the foregoing hydraulic adjustment type involves generation of excessively large frictional force when a cam sliding portion 12 slides on the cam 17 of the metal tappet 10 as shown in FIG. 5. As a result, there arises a problem in that the crank shaft must bear an excessively heavy load, and therefore the efficiency of the engine deteriorates.

Moreover, the employed mechanism, in which oil is enclosed in the tappet, raises the ratio at which the foregoing oil reservoir occupies the inside portion of the tappet, and the weight of the tappet is increased excessively, causing a problem to arise in that the transmission loss occurring due to the vertical motion of the valve 18 becomes critical.

In a recent circumstance in which a study has been made in such a manner that the valve is made of ceramic material to reduce the weight to make smooth the movement of the valve so as to improve the efficiency of the engine, use of the conventional metal tappet encounters a problem that the weight of the valve mechanism cannot satisfactorily be reduced, and accordingly the desired effect of using the ceramic valve cannot be obtained.

SUMMARY OF THE INVENTION

The present invention is directed to overcome the foregoing problems experienced with the conventional technology, and therefore an object of the same is to provide a hydraulic tappet capable of efficiently using the force transmitted from the crank shaft, therefore reducing the transmission loss and improving the efficiency of the engine.

The inventor of the present invention has studied energetically to overcome the foregoing problems, resulting in that use of ceramic material to form the tappet enables the foregoing problems to be overcome. Thus, the present invention was found.

That is, a hydraulic tappet according to the present invention is characterized by a hydraulic tappet for a valve mechanism of an internal combustion engine, the hydraulic tappet provided with a cam sliding portion, a skirt portion and a spring holding portion, wherein at least a portion of the component elements is made of ceramic.

A hydraulic tappet according to another aspect of the present invention is characterized by a hydraulic tappet for a valve mechanism of an internal combustion engine, the hydraulic tappet provided with a cam sliding portion, a skirt portion and a spring holding portion, wherein the spring holding portion and a joint portion are made of metal, a ceramic cap member is mounted on the metal elements, and the cap member works as the sliding portion and the skirt portion.

The present invention has the arrangement that at least a portion of the cam sliding portion, the skirt portion and the spring holding portion of the hydraulic tappet is made of ceramic material.

Therefore, the total weight of the tappet can be reduced, and the ratio of the power loss occurring during transmission from the crank shaft can be lowered so that the transmission characteristics can be improved.

In particular, the arrangement that the cam sliding portion is made of ceramic material exhibiting superior sliding characteristics to the metal material enables the frictional force between a cam and the cam sliding portion, which can be generated when the cam is rotated, to be reduced.

Since the method in which oil is enclosed in the tappet is replaced by a structure having an oil supply port formed in the side wall of the tappet to supply oil from outside and oil is reserved in the spring holding portion, the proportion of the oil reservoir occupying the tappet can significantly be lowered. Therefore, the total weight of the tappet can be reduced to about two-third to half of that of the conventional tappet, and accordingly the transmission characteristics from the crank shaft can be improved so that the efficiency of the engine can be improved.

DETAILED DESCRIPTION OF THE INVENTION

The present invention will now be described through embodiments with reference to the drawings.

Figure 1:
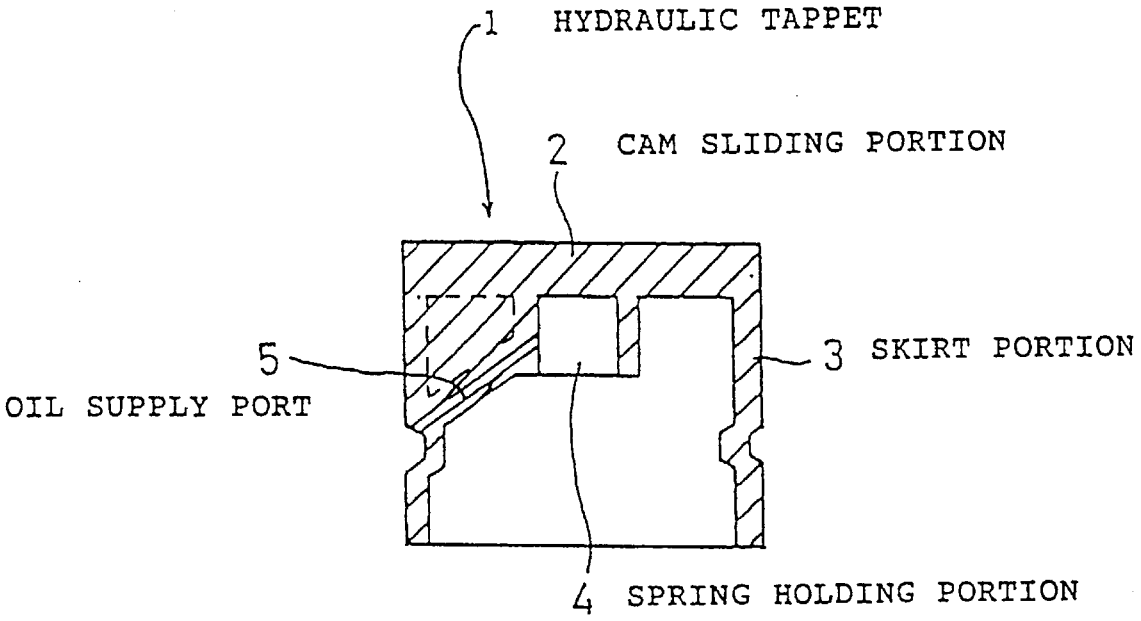
FIG. 1 is a cross sectional view which illustrates an embodiment of a hydraulic tappet according to the present invention.

FIG. 1 is a cross sectional view which illustrates an example of a hydraulic tappet according to the present invention. The hydraulic tappet 1 has a cam sliding portion 2, a skirt portion 3 and a spring holding portion 4, all of which are made of ceramic, resulting in that the weight can be reduced as compared with a structure in which they are made of metal. Since ceramic exhibits excellent sliding characteristics, the frictional force can significantly be reduced between the cam sliding portion 2 and a cam (omitted from illustration). As a result, the efficiency of the engine can be improved. Although the type of the ceramic material to be employed is not limited particularly, it is exemplified by $Si_3N_4$ and sialon. In particular, $Si_3N_4$ exhibits excellent friction characteristics with chilled cast iron, which is the material of the cam, resulting in that it can preferably be employed.

Figure 5:
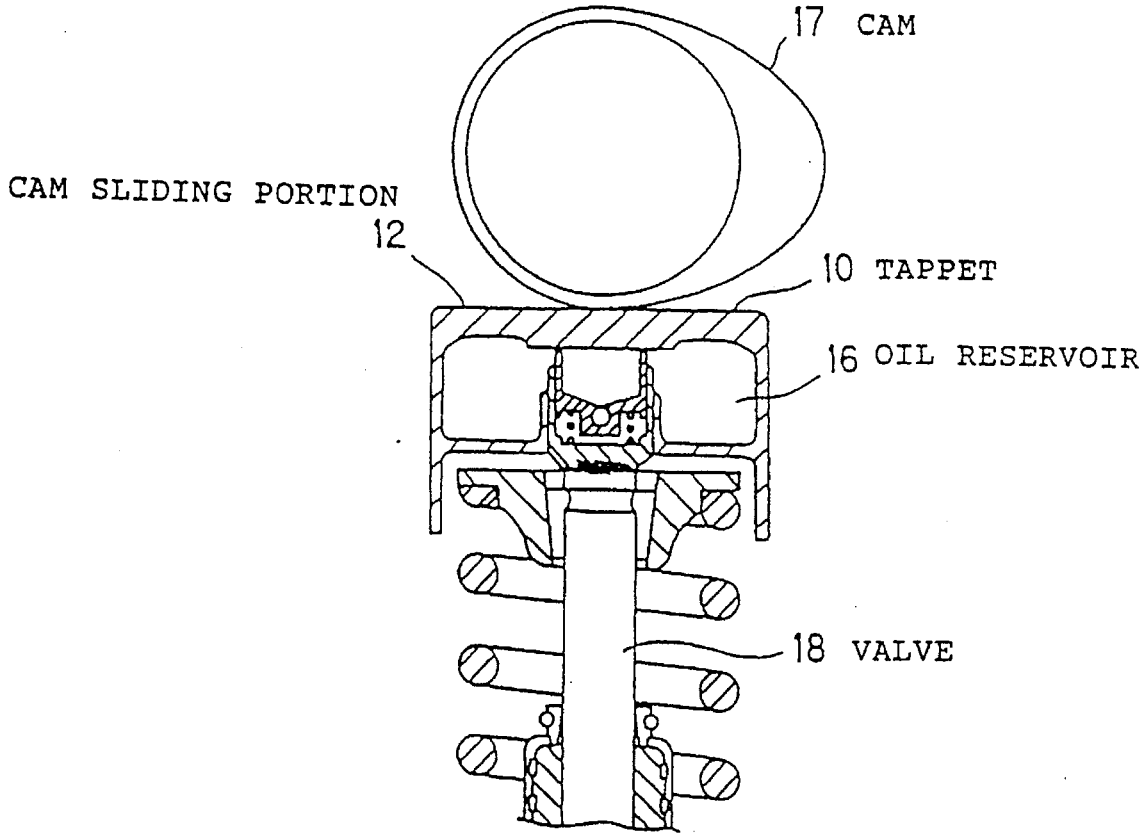
Figure 5 PRIOR ART
FIG. 5 is a cross sectional view which illustrates a conventional hydraulic adjustment type tappet.

Further, it is preferable that the structure be formed in such a way that an oil supply port 5 is formed between the skirt portion 3 and the spring holding portion 4 to be supplied with oil from outside as the tappet 1 is operated and that oil be reserved in only the spring holding portion 4. That is, the spring holding portion 4 acts to guide and hold a spring (omitted from illustration) and serves as an oil reservoir. Therefore, as contrasted with the conventional hydraulic tappet arranged in such a manner that oil is enclosed in the tappet by forming an oil reservoir to surround the spring holding portion (see FIG. 5), this embodiment has the arrangement that only the spring holding portion 4 serves as the oil reservoir and required oil is supplied from outside. As a result, the size of the oil reservoir can be reduced, and therefore the total weight of the tappet can be reduced in addition to the weight reduction realized by the ceramic material. Therefore, the efficiency of the engine can further be improved.

Since the tappet 1 is made of ceramic, excellent heat resistance and corrosion resistance can, of course, be exhibited as compared with the conventional hydraulic tappet. An integrated-structure ceramic tappet can easily be manufactured by an injection molding method or a slip cast method or the like. Further, it can be formed into a near-net shape which requires substantially no time in the post-machining process. The oil supply port 5 can be manufactured by using a mold having, for example, a pin-shape insert.

Figure 2:
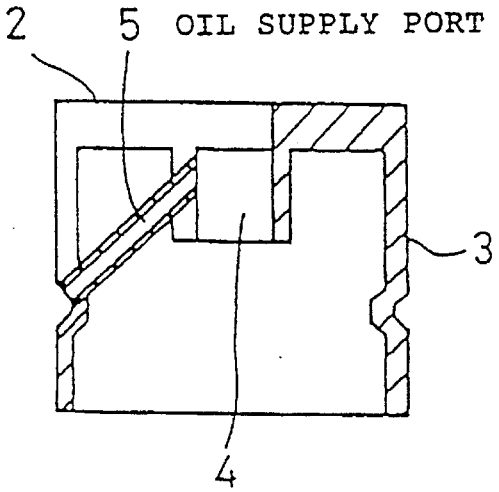
FIG. 2 is a cross sectional view which illustrates another embodiment of a hydraulic tappet according to the present invention.

FIG. 2 illustrates another example of the hydraulic tappet according to the present invention. In the description below, substantially the same elements as the foregoing elements are given the same reference numerals and their descriptions will be omitted.

In this embodiment, the oil supply port 5 is formed of a metal pipe. Although a ceramic usually requires a great many processes to be manufactured and machined in detail, for example, forming an aperture, the arrangement that the oil supply port 5 is formed of the metal pipe facilitates machining. Therefore, the cost can be reduced. The metal pipe can easily be connected to the body of the ceramic tappet by press-fitting or brazing. Further, the weight can be reduced in this case as compared with the conventional arrangement that the tappet is fully made of metal material.

Figure 3:
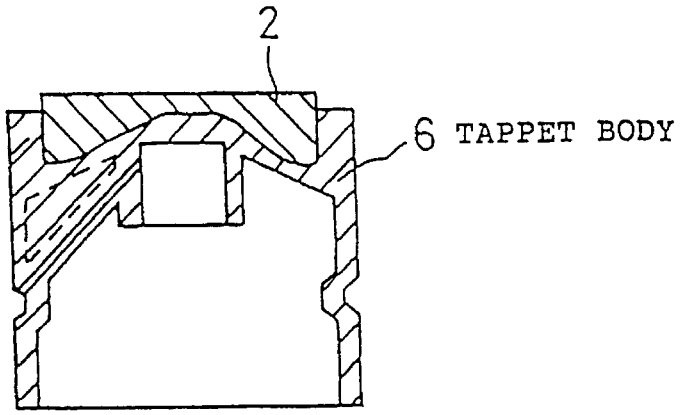
FIG. 3 is a cross sectional view which illustrates another embodiment of a hydraulic tappet according to the present invention.

FIG. 3 is a cross sectional view which illustrates another embodiment of the hydraulic tappet according to the present invention. As shown in the figure above, this embodiment has an arrangement that only the cam sliding portion 2 is made of ceramic. The cam sliding portion 2 is formed while being internally chilled by a metal tappet body 6. It may be joined by shrinkage fitting or brazing. The frictional force between the cam and the tappet can be reduced as described above, manufacturing of the type can further be facilitated as well.

Figure 4:
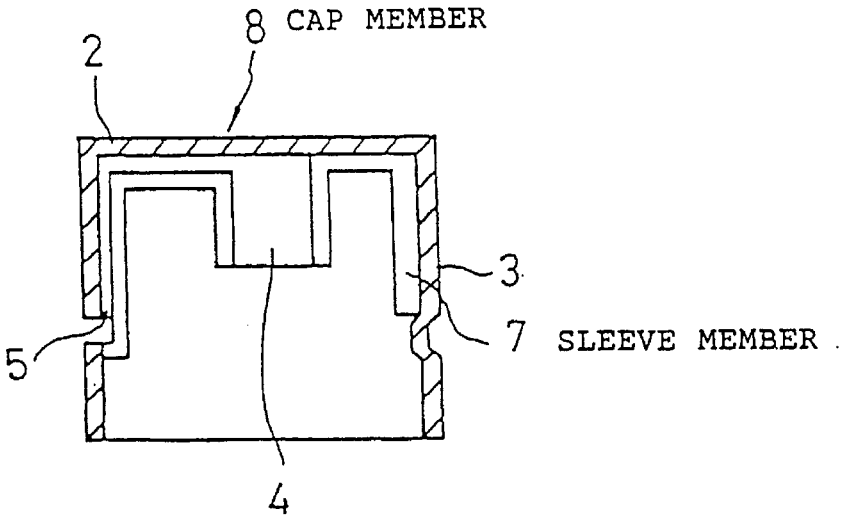
FIG. 4 is a cross sectional view which illustrates another embodiment of a hydraulic tappet according to the present invention.

FIG. 4 is a cross sectional view which illustrates another example of the present invention. A metal sleeve member 7 having the spring holding portion 4 is formed, and the sleeve member 7 is inserted into a ceramic cap member 8 having the cam sliding portion 2 and the skirt portion 3 so that a hydraulic tappet is constituted. The oil supply port 5 is formed by providing a small gap between the cap member 8 and the sleeve member 7.

By also using the metal sleeve member, the tappet can easily be manufactured, and the cost can be reduced. In addition, the mechanical strength of the tappet can be improved.

Although the present invention has been described through the embodiments, the present invention is not limited to the foregoing embodiments. It may be modified variously within the spirit and scope of the present invention. For example, the present invention can be applied to a variety of internal combustion engines as well as to the engine for an automobile. By combining it with a ceramic cam and/or a valve, the efficiency of the engine can further be improved.

As described above, according to the present invention, the ceramic material is used to form the tappet so that there can be provided the hydraulic tappet capable of efficiently using the motive power from the crank shaft, reducing the transmission loss and improving the efficiency of the engine.

What is claimed is:

1. A hydraulic tappet for a valve mechanism of an internal combustion engine, said hydraulic tappet comprising a cam sliding portion, a skirt portion, a spring holding portion disposed downwardly under the cam sliding portion, and an oil supply port provided between said spring holding portion and said skirt portion and formed from a metal tube, said port connecting said spring holding portion and said skirt portion, and wherein the cam sliding portion, skirt portion and spring holding portion are formed of an integrated ceramic.

2. A hydraulic tappet according to claim 1, wherein said portions are a unitary structure.

3. A hydraulic tappet according to claim 1, wherein the tappet has an arrangement that oil is reserved in said spring holding portion.

* * * * *